United States Patent [19]

Barenberg

[11] 4,453,360

[45] Jun. 12, 1984

[54] LOAD TRANSFER DEVICE FOR JOINTS IN CONCRETE SLABS

[75] Inventor: Ernest J. Barenberg, Champaign, Ill.

[73] Assignee: The Board of Trustees of the University of Illinois, Urbana, Ill.

[21] Appl. No.: 339,698

[22] Filed: Jan. 15, 1982

[51] Int. Cl.[3] ..... E01C 11/10; E04F 15/14; E04B 1/68

[52] U.S. Cl. ..... 52/396; 404/68

[58] Field of Search ..... 52/396, 393, 395, 573; 404/47, 50, 56

[56] References Cited

U.S. PATENT DOCUMENTS

| | | | |
|---|---|---|---|
| 2,125,857 | 8/1938 | Fischer | 404/56 |
| 2,208,000 | 7/1940 | Geyer | 404/58 |
| 2,228,052 | 1/1941 | Gardner | 52/396 |
| 3,023,681 | 3/1962 | Worson | 404/56 |

FOREIGN PATENT DOCUMENTS

| | | | |
|---|---|---|---|
| 17664 | 5/1934 | Australia | 404/56 |
| 1116369 | 11/1961 | Fed. Rep. of Germany | 52/396 |

*Primary Examiner*—John E. Murtagh

*Attorney, Agent, or Firm*—Mathew L. Kalinowski

[57] ABSTRACT

A load transfer device, adapted to be grouted into a core hole drilled vertically through the joint between adjoining concrete slabs, includes a hollow diamond-shaped member and anchoring blades attached to opposite sides thereof. The device permits efficient transfer of shear across the joint while maintaining the necessary flexibility to permit expansion and contraction of the joint. A resilient shield is fitted over the faces of the diamond-shaped member to prevent binding of the grout to the faces and to minimize corrosion. The interior hollow space of the diamond-shaped member is filled with a resilient core to eliminate contamination with road debris and other foreign matter.

5 Claims, 1 Drawing Figure

LOAD TRANSFER DEVICE FOR JOINTS IN CONCRETE SLABS

This invention was made in the course of work supported by a grant from the U.S. Department of Transportation.

This invention relates to a device for transferring load across joints and cracks in concrete slabs. More particularly, this invention relates to a device for minimizing or eliminating misalignment of concrete slabs in highway and airport pavements due to heavy vehicular loads.

Concrete slabs in highway and airport pavements are subjected to severe stresses and strains as a result of temperature and moisture gradients through the slabs as well as repeated traffic loads. To relieve some of these stresses and strains joints are cut in the slabs to effectively reduce the slab lengths. These joints, however, can become misaligned or "fault" unless load transfer devices are installed to keep the slabs acting in unison. A wide variety of such devices for installation in newly constructed pavements is known. For example, Robertson, U.S. Pat. No. 2,149,467 discloses a system of rigid plates to provide load transmitting means in road joints. Other devices include Dowels, keyways, tie bars, star lugs, and the like.

The above-cited devices can, with time and repeated load applications, become ineffective and allow the slabs to fault. Furthermore, if the initial joint spacing in the slabs is too great, the slabs will crack at some intermediate point between the joints, and these cracks can fault in much the same manner as joints with old or worn out load transfer devices. Also, when patching existing concrete pavements it is frequently necessary to install load transfer devices between the patch and the existing pavement slab. Since the existing concrete is already set, it is difficult and expensive to install dowells, star lugs, and the like which are intended primarily for installation in plastic concrete.

More recently, a device shaped like a figure 8 has been reported by Ledbetter, W. B. et al., "Techniques for Rehabilitating Pavements Without Overlays - A system Analysis - Vol. 1 Analyses", Report No. FHWA-RD-78108, September 1977, pp. 154–161. The device has worked well on joints which were not required to open and close, but it does not allow for the horizontal slab movements necessary at most joints to compensate for changes in slab length due to moisture and temperature changes. Thus, its use is limited to connecting a maximum of two short slabs.

Accordingly, it is an object of this invention to provide a device for transferring load across the joint between adjoining concrete slabs while at the same time allowing the joint to expand and contract due to temperature and moisture changes.

It is another object of this invention to provide a load transfer device that can be readily retrofitted into hardened concrete slabs.

It is still another object of this invention to provide a load transfer device that improves the life span and rideability of concrete pavements.

These and other objects will become apparent as description of the invention proceeds.

This invention provides a load transfer device which is designed to be grouted into a core hole drilled vertically through the joint between adjoining concrete slabs, and which includes a hollow diamond-shaped member and anchoring blades attached to opposite sides thereof. A resilient shield is fitted over the faces of the diamond-shaped member to prevent binding of the grout to the faces. Thus, free expansion and contraction of the joint can occur as a result of the bellows-like action of the diamond-shaped member. The interior hollow space of the diamond-shaped member is filled with resilient material to eliminate contamination with road debris and other foreign matter. The installed device provides efficient transfer of shear load across the joint while maintaining the necessary flexibility to permit expansion and contraction of the joint.

Suitably, the diamond-shaped member and the anchoring blades can be constructed from a mild steel. The device can be dipped in an epoxy coating material to improve anchoring strength and to minimize corrosion. The shield covering the diamond-shaped member can be a resilient, organic polymeric material such as, for example, foamed rubber, polyurethane, polystyrene, polyethylene, polypropylene, and the like. The core material filling the hollow of the diamond-shaped member can also be a resilient, organic polymeric material similar to the shield material.

The device is sized to fit the core hole drilled vertically in the joint between the slabs. The diamond-shaped member is aligned with the center line of the joint while the anchoring blades are embedded in the grout securing the device to the slabs. Flanges, reinforcing ribs, and the like can be incorporated into the anchoring blades to increase anchoring strength. It is imperative that the grout have sufficient strength to transfer the full shear capacity of the device.

In a typical installation, core holes, drilled about three to about six inches in diameter to the full depth of the pavement, are spaced at about 30 to about 36 inch intervals along the joint. A device of the proper size is dropped into the hole and grouted into place, suitably with a polymeric concrete.

DESCRIPTION OF THE PREFERRED EMBODIMENTS

Figure 1:
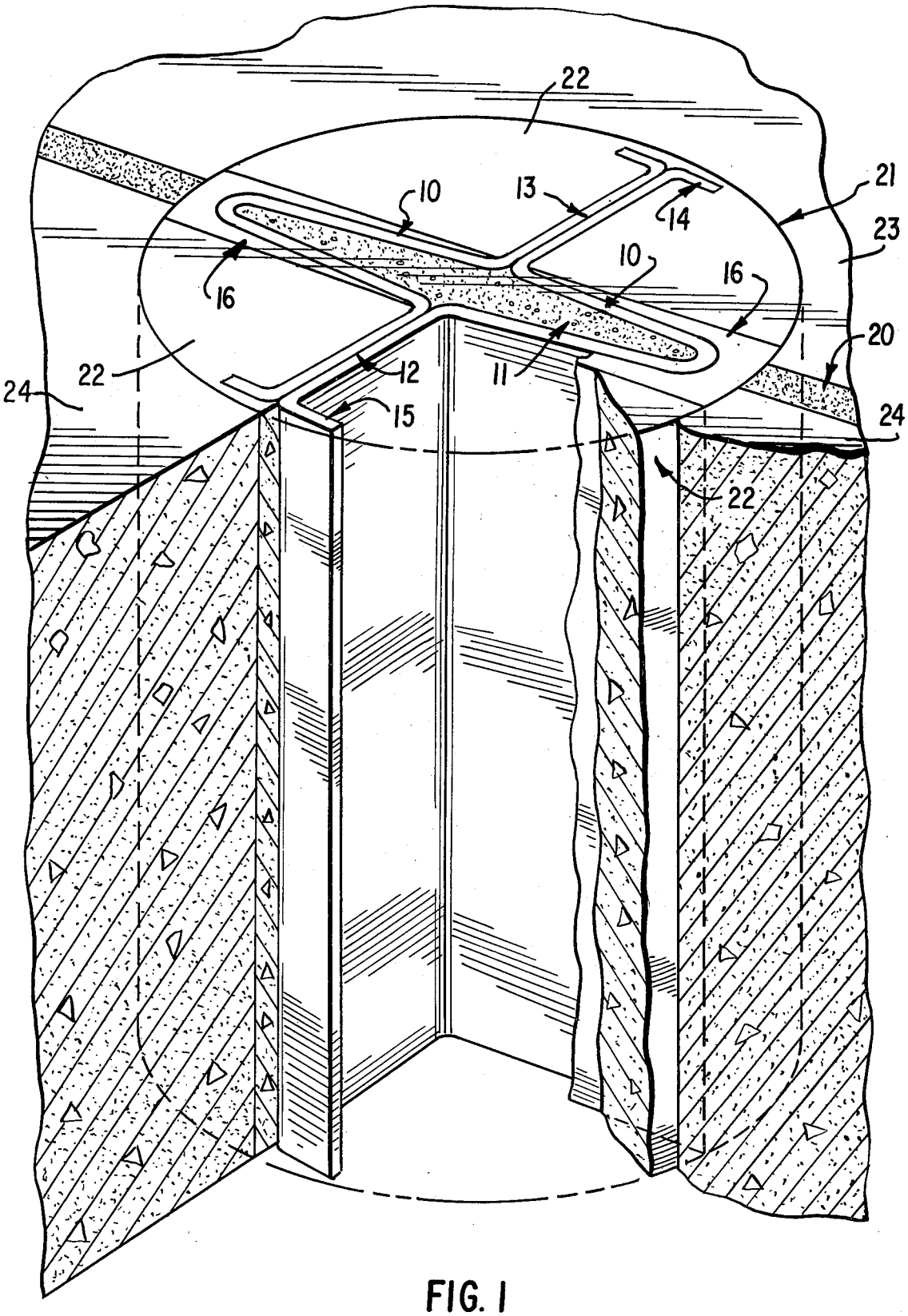
FIG. 1 is a perspective view of the load transfer device installed in a core hole drilled in the joint between two concrete slabs.

The invention is further illustrated by reference to the following procedures and examples.

The device shown in FIG. 1 was fabricated from a mild 11 guage steel meeting ASTM specifications for A-36 steel. Diamond-shaped member 10 and anchoring blades 12 and 13, provided with flanges 15 and 14, were sized to fit core hole 21 drilled in joint 20 between concrete slabs 23 and 24. Foamed rubber shield 16 was applied to the external faces of member 10. Poylurethane foam 11 was used to fill the internal hollow space in member 10.

For laboratory tests, two 15"×16"×8" concrete blocks were tied together and core holes were drilled through the blocks across the joint. Both three inch and six inch core diameters were used. Load transfer devices were inserted in the core holes and were grouted with a grout made from commercially available epoxy material and Ottawa sand. After three days of curing at 75° F. the grout was stronger than the concrete, and the specimens were ready for testing.

The specimens were subjected to compression, tension, shear, moment, and fatigue tests. In all of these tests the device of this invention was equivalent or superior to prior-art devices. The superior flexibility of the inventive device in joint opening and closing was clearly shown in the tension and compression tests. The device was particularly effective in its ability to transfer load efficiently across the joint by shear action, as was demonstrated by results from the direct shear test and fatigue test. In fatigue tests, six-inch devices were tested under repeated loads of 25,000 pounds for over four million repititions without failure.

Experimental field tests in airport pavements confirmed the laboratory results. Six-inch devices were installed at 30-inch intervals in 12-inch thick jointed concrete pavement at the airport and compared with plate and stud transfer devices. The relative deflection across the joints both before and after installation of the devices was measured. The tests were run with 55,000 pound wheel loads moving across the joints. The relative deflection across the joints as the wheel crossed was measured with linear transformers attached to a beam resting on the slab away from the loaded area. In each test the wheel is moved perpendicular to the joint and crosses it at right angles. Test results are tabulated as follows:

| | Deflection, inches | | |
|---|---|---|---|
| | Before | After Repair | |
| Type of Device | Repair | First Pass | 200th Pass |
| Diamond-Shaped | .050 | .001 | .001 |
| Diamond-Shaped | .058 | .004 | .003 |
| Plate & Stud | .035 | .003 | .001 |
| Plate & Stud | .043 | .001 | .002 |
| Plate & Stud | .025 | .003 | .003 |
| Plate & Stud | .035 | .005 | .004 |

It is clear that the diamond-shaped device of this invention is effective in arresting distress in these pavements. After nearly four months of usage under traffic conditions, no additional distress was found in the treated slabs.

Although this invention has been described with particular reference to certain preferred embodiments thereof, it is understood that variations and modifications can be effected within the spirit and scope of the appended claims. It is intended that all matter contained in the above description, table, and figure shall be interpreted in an illustrative and not in a limiting sense.

What is claimed is:

1. A device transferring load across a joint in adjoining concrete pavement slabs which device comprises:

(a) a hollow, rigid diamond-shaped member the exterior faces of which are covered with resilient shielding means; and (b) rigid anchoring means attached to opposite sides of the diamond-shaped member;

the device being fitted and grouted into a core hole drilled vertically through the joint between the adjoining slabs, and to be positioned so that the anchoring means are embedded in the grout to secure the device to the slabs and so that the diamond-shaped member is aligned with the center line of the joint to permit expansion and contraction of the joint; and said device being of rigidity capable of transferring vehicular wheel loading across the joint to an extent sufficient to minimize faulting of the adjoining slabs due to said vehicular wheel loading.

2. The device of claim 1 having a rigidity sufficient to transfer effectively a wheel load of at least about 50,000 lbs.

3. The device of claim 1 wherein the hollow interior space of the diamond-shaped member is filled with a resilient packing.

4. The device of claim 3 wherein the resilient shielding means and packing are selected from the group consisting of foamed rubber, polyurethane, polystyrene, polyethylene, and polypropylene.

5. The device of claim 1 wherein the anchoring means comprise flanged blades.

* * * * *